US006884559B2

(12) United States Patent
Yokota

(10) Patent No.: US 6,884,559 B2
(45) Date of Patent: Apr. 26, 2005

(54) ELECTROPHOTOGRAPHIC IMAGING METHOD

(75) Inventor: Saburo Yokota, Gyeonggi-do (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 54 days.

(21) Appl. No.: 10/391,762

(22) Filed: Mar. 20, 2003

(65) Prior Publication Data

US 2003/0186158 A1 Oct. 2, 2003

(30) Foreign Application Priority Data

Mar. 21, 2002 (KR) ..... 10-2002-0015369

(51) Int. Cl.[7] ..... G03G 13/10
(52) U.S. Cl. ..... 430/117; 430/59.6
(58) Field of Search ..... 430/117, 59.6, 430/96

(56) References Cited

U.S. PATENT DOCUMENTS 2,907,674 A 10/1959 Metcalfe et al.
3,337,340 A 8/1967 Matkan
5,030,532 A 7/1991 Limburg et al.
5,368,967 A 11/1994 Schank et al.
5,545,499 A 8/1996 Balthis et al.
5,780,194 A * 7/1998 Katsukawa et al. ..... 430/83
5,882,814 A * 3/1999 Fuller et al. ..... 430/58.35

FOREIGN PATENT DOCUMENTS

JP 05-297601 11/1993
JP 07-2811456 10/1995
JP 10-020515 1/1998

* cited by examiner

*Primary Examiner*—John L Goodrow
(74) *Attorney, Agent, or Firm*—Staas & Halsey LLP

(57) ABSTRACT

An electrophotographic imaging method, wherein a liquid developer directly contacts an electrophotographic organic photoreceptor to develop an image, utilizes a binder contained in a surface layer of the organic photoreceptor that comprises a polyester resin having a main chain of a biphenylfluorene repeating unit. Since the organic photoreceptor has effective initial electrostatic characteristics and experiences little change in electrostatic characteristics before and after soaking in a solvent for a liquid developer, even when the liquid developer directly contacts an organic photoreceptor, the organic photoreceptor is not eroded by the solvent, and the developer is not contaminated. Therefore, stable development can be performed.

15 Claims, No Drawings

ELECTROPHOTOGRAPHIC IMAGING METHOD

CROSS-REFERENCE TO RELATED APPLICATIONS

This application claims the priority of Korean Patent Application No. 2002-15369, filed Mar. 21, 2002, in the Korean Intellectual Property Office, the disclosure of which is incorporated herein by reference.

BACKGROUND OF THE INVENTION

1. Field of the Invention

This invention relates generally to an electrophotographic imaging method, and more particularly, to an electrophotographic imaging method in which an image is formed by directly contacting a liquid developer on the surface of an organic photoreceptor.

2. Description of the Related Art

In electrophotography, the surface of a photoconductive element is selectively exposed to light to form a latent image, and a difference in electrostatically charging density between an exposed area and non-exposed area is generated to form a visible image by an electrostatic toner containing pigments or thermoplastic components.

In electrotography, wet type developing using liquid developers, as disclosed in U.S. Pat. Nos. 2,907,674 and 3,337,340, has been well known for a long time, and liquid developers are capable of producing very high resolution images because of the small particle size, ranging to sub-micron size.

However, the wet type developing method has not been widely used because of several drawbacks, such as flammability or offensive odor due to a petroleum-based solvent as a main component of liquid developer. Thus, a dry type developing method using dry powder developers has been generally regarded as one of representative developing methods.

Owing to the advantage of the capability of producing very high resolution images, much attention has been being paid again to wet type developing in recent years.

In wet type developing, an electrostatic image is formed on the surface of a photosensitive layer and is then moved to another surface. The surface is wetted using a liquid carrier containing a pigment and having electrostatic resistance enough to suppress damage of the electrostatic image, thus achieving development.

In wet type developing using liquid developers, inorganic photoreceptors such as amorphous selenium have been used conventionally, but when this method was applied to organic photoreceptors, the following problems were found.

If the surface of an organic photoreceptor is formed of a charge transport layer containing a binder, e.g., a polycarbonate-based resin or acryl-based resin, and a low molecular weight compound, i.e., a charge transport material, the charge transport layer forming materials are soluble in an aliphatic hydrocarbon-based solvent of a liquid developer. The liquid developer is prepared by dispersing pigment particles in an aliphatic hydrocarbon-based solvent.

Thus, when the liquid developer directly contacts an organic photoreceptor, the organic photoreceptor erodes by dissolving in the solvent, causing cracking or lowered photosensitivity, or resulting in contamination of the developer by photoreceptor components.

To overcome the above-described problems, research into photoreceptors having good durability with respect to liquid developers is being actively carried out. There are approximately three ways which have been proposed for attaining such organic photoreceptors, as follows:

(1) Polymerizing photoreceptor components, e.g., charge transport materials to prevent the same from being dissolved in solvent;

(2) Providing an overcoat layer having superior developer resistance to prevent solvent penetration into the photosensitive layer; and (3) Improving the developer resistance of a binder to prevent solvent penetration into a photosensitive layer.

For example, U.S. Pat. No. 5,030,532 is classified as (1), but this method includes disadvantages, for example, the low number of available polymeric charge transport materials with superior solvent resistance and a lack of availability of a common resin, which increase the material cost substantially. U.S. Pat. No. 5,368,967 is classified as (2); nevertheless, the overcoat requires a complicated procedure for preparation and should be a thin layer for good electrical performance, so the photoreceptor includes a difficulty in obtaining a physically durable overcoat. U.S. Pat. No. 5,545,499 is classified as (3), but this method has the disadvantage of finding a photoreceptor which has enough solvent resistance, and so far a suitable photoreceptor has not been found.

Japanese Patent Laid-open Publication Nos. Hei 5-297601, 7-281456 and 10-20515 disclose an organic photoreceptor using a polyester resin having a biphenyl fluorene repeating unit in the main chain as a binder.

According to the above-cited patents, various attempts based on general electrophotography were made to improve mechanical durability by using particular polyester resins, but the applicability of liquid developing was not taught. Also, compared to conventional resins, the resins disclosed in the above-cited patents have poor electrical properties, and have not been practically used as photoreceptor materials.

SUMMARY OF THE INVENTION

This invention provides an electrophotographic imaging method with improved durability against being dissolved by a solvent contained in a liquid developer.

In accordance with an aspect of the present invention, an electrophotographic imaging method in which a liquid developer directly contacts an electrophotographic organic photoreceptor. , A binder contained in a surface layer of the organic photoreceptor comprises a polyester resin having a main chain of a biphenylfluorene repeating unit represented by Formula 1:

Formula 1

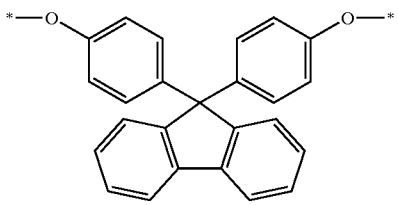

wherein hydrogen atoms on aromatic rings are unsubstituted or substituted with one selected from the group consisting of a halogen atom, an aliphatic hydrocarbon group having 1 to 20 carbon atoms and a cycloalkyl group having 5 to 8 carbon atoms.

The polyester resin is preferably a polyester resin having a repeating unit represented by Formula 2, 3 and 4 or a copolymer having two or more of the following categories of repeating units:

Formula 2

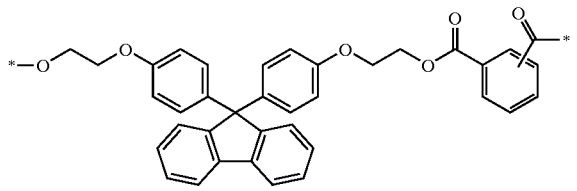

Formula 3

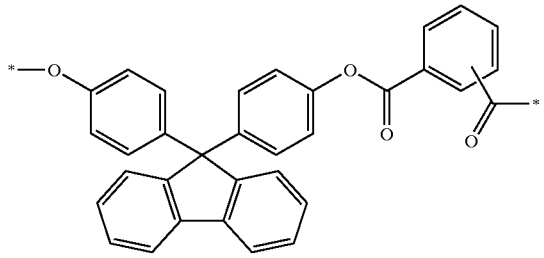

Formula 4

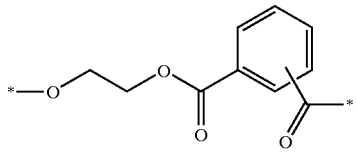

The polyester resin is more preferably a compound represented by Formula 5 or 6.

Formula 5

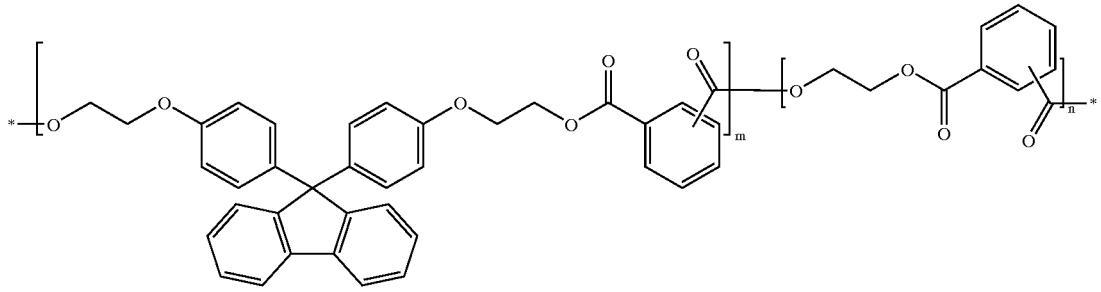

wherein m and n are independently an integer between 10 and 1000,

Formula 6

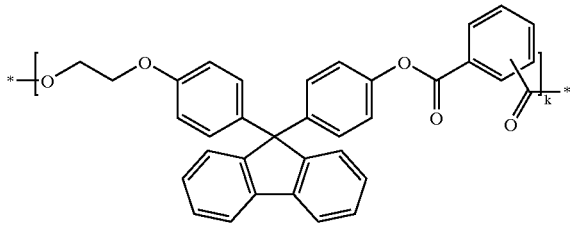

wherein k is an integer between 10 and 1000.

The weight average molecular weight of the polyester resin is preferably in the range of about 20,000 to about 200,000, and the content thereof is preferably 50 to 100% by weight based on the total weight of the binder.

In the electrophotographic imaging method according to an embodiment of the present invention, an aliphatic hydrocarbon-based solvent is used as a solvent of the liquid developer.

When the organic photoreceptor comprises a conductive base and a photosensitive layer laminated thereon, the photosensitive layer is constructed of a dual-layered structure in which a charge generation layer and a charge transport layer are sequentially laminated or inversely laminated, or is a single layered structure in which a charge transport material and a charge generating material are mixed. Otherwise, the photoreceptor may have a multiple layered structure in which a photosensitive layer and an overcoat layer are sequentially laminated on the conductive base.

DETAILED DESCRIPTION OF THE PREFERRED EMBODIMENTS

A surface layer of the photoreceptor according to an embodiment of the present invention includes a polyester resin having a biphenylfluorene repeating unit represented by Formula 1 in the main chain as a binder. When a liquid developer directly contacts the surface of the photoreceptor, the polyester resin exhibits excellent durability against being dissolved by the liquid developer.

Formula 1

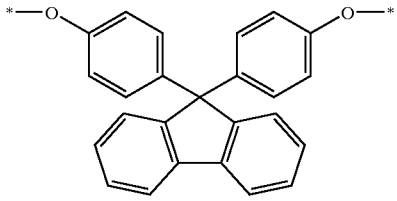

wherein hydrogen atoms in an aromatic ring are unsubstituted or are substituted by one selected from the group consisting of a halogen atom, a $C_1$–$C_{20}$ aliphatic hydrocarbon and a $C_5$–$C_8$ cycloalkyl group.

In the Formula 1, examples of the halogen atom include F, Cl, Br and I examples of the $C_1$–$C_{20}$ aliphatic hydrocarbon include a methyl and an ethyl group, and an example of the $C_5$–$C_8$ cycloalkyl group includes the cyclohexyl group.

The weight average molecular weight of the polyester resin is preferably in the range of 20,000 to 200,000. If the weight average molecular weight of the polyester resin is less than 20,000, the mechanical strength of the photosensitive layer is lowered, and the photosensitive layer is easily breakable. If the weight average molecular weight of the polyester resin is greater than 200,000, the solubility of the polymer to a solvent is poor, so that the viscosity of the solution undesirably increases, making coating difficult.

The polyester resin may be a polyester resin having a repeating unit represented by Formula 2, 3 or 4, or a copolymer having two or more repeating units represented by Formula 2, 3 or 4.

Formula 2

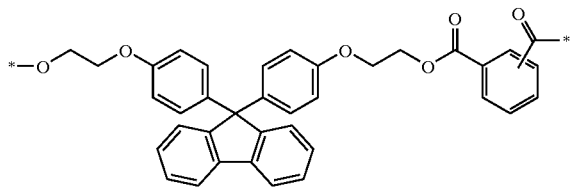

Formula 3

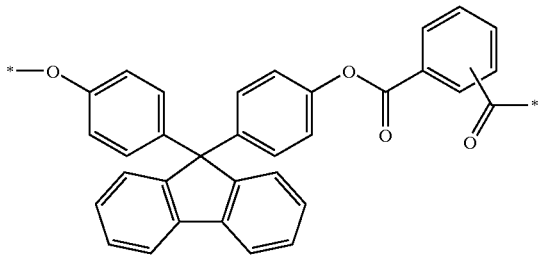

Formula 4

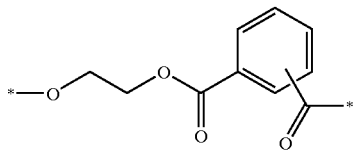

The polyester resin according to an embodiment of the present invention is preferably a compound represented by Formula 5 or 6, wherein m and n are independently integers between 10 and 1000, and Formula 6

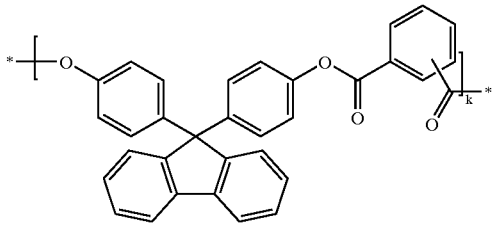

wherein k is an integer between 10 and 1000.

The compound represented by Formula 5 is made by KANEBO CO. under the trade name of O-PET, and the compound represented by Formula 6 is made by ISONOVA CO. under the trade name of ISARYL.

An organic photoreceptor according to an embodiment of the present invention and a manufacturing method thereof are described below. The photoreceptor of an embodiment of the present invention includes a conductive base and a photosensitive layer laminated thereon. The photosensitive layer may have a bilayer structure in which a charge generation layer and a charge transport layer are sequentially stacked, or an inverted bilayer structure. Otherwise, the photosensitive layer may have a single layered structure consisting of a charge generating material and a charge transport material. As the conductive base, a metal or plastic drum-shaped or belt-shaped base is used. Also, the photoreceptor according to an embodiment of the present invention may have a multi-layered structure in which a conductive base, a photosensitive layer, and an overcoat layer are sequentially stacked on the conductive base. The overcoat layer protects underlying layers.

The overcoat layer of the photosensitive layer having the above-described structure includes a polyester resin having a biphenylfluorene repeating unit represented by Formula 1 in the main chain as a binder.

As the binder, the polyester resin having the biphenylfluorene repeating unit represented by Formula 1 in the main chain may be used singly or in a mixed form with other general binder resin within the range of amounts by which the effects of the invention are not adversely affected.

Examples of the general binder resin include polycarbonate resin such as bisphenol-A type polycarbonate (TEIJIN Formula 5

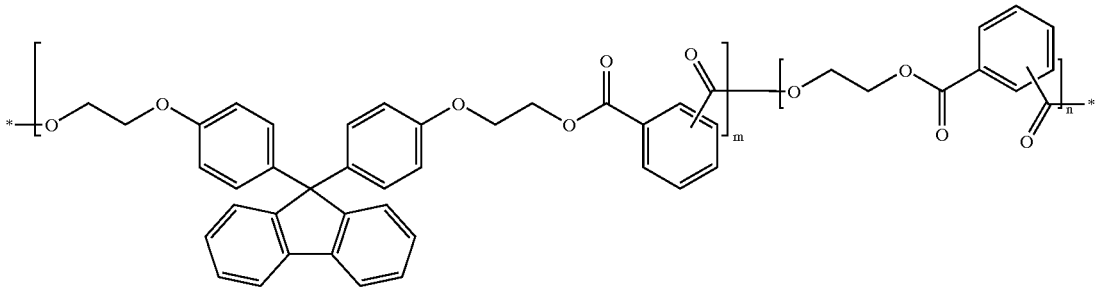

CHEMICAL, PANLITE), bisphenol-Z type polycarbonate (MITSUBISHI GAS CHEMICAL, IUPILON Z-200), methacryl-based resin (MITSUBISHI RAYON'S DIANAL), general polyester resin such as a general polyester resin represented by Formula 9 (TOYOBO CO., LTD., Vylon-200), and polystyrene resin (DOW CHEMICAL, STYLON). The polyester resin having a biphenylfluorene repeating unit represented by Formula 1 is preferably used in an amount of 50 to 100 wt % based on the total weight of the binder used in the overcoat layer of the photoreceptor. If the amount of the polyester resin having abiphenyl fluorene repeating unit represented by Formula 1 is less than 50 wt %, the durability of the polyester resin against being dissolved by a liquid developer becomes poor, Formula 9

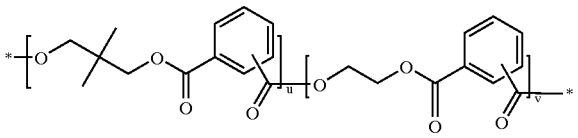

wherein u and v are independently an integer between 10 and 1000.

The method of manufacturing the organic photoreceptor having the above structure is described below. In one embodiment, when the photosensitive layer of the organic photoreceptor has a stacked structure, a charge generation layer forming composition containing a charge generating material, a binder, and a solvent is coated on a conductive base and dried, thus forming a charge generation layer. The content of the charge generating material is 20 to 90 wt % based on the weight of solid content of the charge generation layer forming composition, and the content of the binder is 10 to 80 wt % based on the weight of solid content of the charge generation layer forming composition. If the content of the binder is beyond the above content range, the charge generating material exhibits an undesirable charge generating capability. That is, if the content of the binder is less than 10 wt %, the binding force between the charge transport layer and the charge generation layer is poor. If the content of the binder is greater than 80 wt %, the amount of the charge generating material contained in the charge generation layer is relatively reduced, undesirably reducing the charge generating capability.

Then, the charge transport layer forming composition containing a charge transport material, a binder and a solvent is coated on the charge generation layer and dried to form a charge transport layer, thus forming the organic photoreceptor according to an embodiment of the present invention. The binder in the charge transport layer forming composition has a polyester resin having a biphenylfluorene repeating unit represented by Formula 1 in the main chain. The content of the charge transport material is 10 to 60 wt % based on the weight of the solid content of the charge transport layer forming composition, the content of the binder is 40 to 90 wt % based on the weight of the solid content of the charge transport layer forming composition, and the content of the polyester resin having a biphenylfluorene repeating unit represented by Formula 1 in the main chain is 50 to 100 wt % based on the total weight of the binder. If the content of the charge transport material is less than 10 wt %, the charge transport capability is insufficient so that the sensitivity is low and the remnant potential increases, which are undesirable. If the content of the charge transport material is greater than 60 wt %, the amount of the resin contained in the photosensitive layer is reduced, and the mechanical strength and liquid developer resistance of the photosensitive layer are undesirably lowered.

In some cases, the stack order of the charge transport layer and the charge generation layer may be reversed. In this case, the binder constituting the charge generation layer forming composition must have a polyester resin having a biphenylfluorene repeating unit represented by Formula 1 in the main chain. The content of the polyester resin having a biphenyl fluorene repeating unit represented by Formula 1 in the main chain is preferably 50 to 100 wt %, based on the total amount of the binder used in the charge generation layer forming composition. Also, an overcoat layer forming composition selectively containing a conducting material or a charge transport material is coated on the charge transport layer and dried to form an overcoat layer, and the content of the polyester resin having a biphenylfluorene repeating unit represented by Formula 1 in the main chain is preferably 50 to 100 wt %, based on the total amount of the binder used in the overcoat layer forming composition. The content of the binder contained in the overcoat layer forming composition is 60 to 100 wt %, based on the weight of solid content of the composition.

The case where the photosensitive layer of the organic photoreceptor has a single layer structure is described below. A photosensitive layer forming composition containing a charge generating material, a charge transport material, a binder and a solvent is coated on a conductive base and dried, thus completing an organic photoreceptor. The binder must have a polyester resin having a biphenylfluorene repeating unit represented by Formula 1 in the main chain. The content of the polyester resin having a biphenyl fluorene repeating unit represented by Formula 1 in the main chain is preferably 40 to 90 wt % based on the total amount of solid content of the photosensitive layer forming composition, and the content of the polyester resin having a biphenylfluorene repeating unit represented by Formula 1 in the main chain is preferably 50 to 100 wt % based on the total amount of the binder used in the photosensitive layer forming composition.

In the manufacturing method, coating methods of the charge generation layer forming composition and the charge transport layer forming composition are not particularly limited, but ring coating or dip coating is preferably used. The overall thickness of the thus-formed photosensitive layer is preferably 5 to 50 $\mu$m. The thickness of the charge generation layer constituting the photosensitive layer is in the range of 0.1 to 1 $\mu$m, the thickness of the charge transport layer is preferably in the range of 5 to 50 $\mu$m, and the thickness of the overcoat layer is preferably in the range of 0.1 to 5 $\mu$m.

Examples of the solvent used in the charge generation layer forming composition, the charge transport layer forming composition and the photosensitive layer forming composition include organic solvents such as alcohols, ketones, amides, esters, sulfones, aromatics and aliphatic halogenated hydrocarbons. The alcohols are exemplified by methanol, ethanol, butanol and isopropylalcohol, the ketones are exemplified by acetone, methylethylketone and cyclohexanone, the amides are exemplified by N,N-dimethylformamide and N,N-dimethylacetamide, the esters are exemplified by ethyl acetate and methyl acetate, the sulfones are exemplified by dimethylsulfoxide and sulfolane, the aromatics are exemplified by benzene, toluene, xylene, monochlorobenzene and dichlorobenzene, and the aliphatic halogenated hydrocarbons are exemplified by methylene chloride, chloroform, tetrachlorocarbon and trichloroethane. The contents of such solvents are 2 to 100 parts by weight based on 1 part by weight of solid content of each of the respective compositions, that is the charge generation layer forming composition, the charge transport layer forming composition and the photosensitive layer forming composition.

Examples of the charge generating material according to the present invention include organic materials, such as phthalocyanine pigments, azo pigments, quinone pigments, perylene pigments, indigo pigments, bisbenzoimidazole pigments, quinacridone pigments, azlenium dyes, squarylium dyes, pyrylium dyes, triarylmethane dyes or cyanine dyes, and inorganic materials, such as amorphous silicon, amorphous selenium, trigonal selenium, tellurium, selenium-tellurium alloy, cadmium sulfide, antimony sulfide or zinc sulfide.

As the charge transport material of the present invention, either a hole transport material or an electron transport material can be used. Examples of the hole transport material include nitrogen-containing cyclic compounds such as pyrenes, carbazoles, hydrazones, oxazoles, oxadiazoles, pyrazolidines, arylamines, arylmethanes, benzidines, thiazoles or styryls, condensed polycyclic compounds or mixtures thereof. Examples of other useful hole transport materials include polymer compounds having substituents thereof in the main chain or side chain, and polysilane compounds. Examples of the electron transport material include electron attracting materials such as benzoquinone, cyanoethylene, cyanoquinodimethane, fluorene, xantone, phenanthraquinone, anhydrous phthalic acid, thiopyrane or diphenoquinone, and mixtures thereof. In the present invention, compounds represented by Formula 7 or 8 are preferably used as the hole transport material.

Formula 8

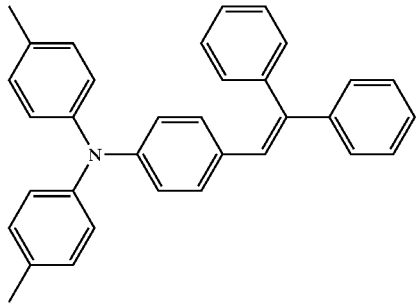

The organic photoreceptor of the present invention may further include an additive layer. Examples of such an additional layer include an intermediate layer formed between a conductive base and a photosensitive layer to enhance the adhesiveness therebetween or to prevent charges from being injected from the base.

Also, the photosensitive layer and/or overcoat layer of the present invention may further include additives such as a plasticizer, a levelling agent, a dispersion stabilizer, an anti-oxidant agent or a light stabilizer as well as a binder. Examples of the anti-oxidant agent include phenol compounds, sulfur compounds, phosphorus compounds and amine compounds. Examples of the light stabilizer include benzotriazole compounds, benzophenone compounds and hindered amine compounds.

A process of forming an electrophotographic image using the organic photoreceptor is described below. The surface of the organic photoreceptor is uniformly electrostatically charged, and the charged surface is exposed to a pattern of light to form an electrostatic latent image on the surface of the organic photoreceptor. Next, the surface of the organic photoreceptor having the electrostatic latent image is directly contacted with a liquid developer for developing, to form a temporary image, followed by transferring the same to the surface of a receptor such as paper or carrier.

The liquid developer is prepared by dispersing a colorant, a charge control agent or the like, in a solvent. Examples of the solvent include aliphatic hydrocarbons such as n-pentane, hexane or heptane, alicyclic hydrocarbons such as cyclopentane or cyclohexane, aromatic hydrocarbons such as benzene, toluene or xylene, halogenated hydrocarbons such as chlorinated alkane, fluorinated alkane or chlorofluorocarbon, silicon oils and blends of these materials. Specifically, preferred solvents are aliphatic hydrocarbon-based solvents, more preferably branched paraffin solvent blends, such as ISOPAR G, ISOPAR H, ISOPAR K, ISOPAR L, ISOPAR M, ISOPAR V (made by Formula 7

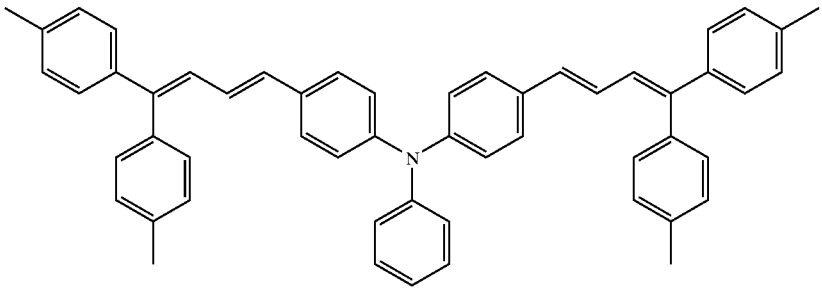

EXXON CORPORATION), NORPAR 12, NORPAR 13 and NORPAR 15 (made by EXXON CORPORATION). The content of the solvent is 5 to 100 parts by weight based on 1 part by weight of a colorant.

Useful colorants are well known in the art and include materials such as dyes, stains, and pigments. Non-limiting examples of typically suitable colorants include: phthalocyanine blue (C.I. PIGMENT BLUE), monoarylide yellow (C.I. PIGMENT YELLOW), diarylide yellow, arylamide yellow, azo red, quinacridone magenta and black pigments, such as finely divided carbon and the like.

As described above, the use of the polyester resin having a biphenyl fluorene repeating unit represented by Formula 1 as a binder forming the overcoat layer of the organic photoreceptor according to the present invention has advantages in that cracks are not produced to the photosensitive layer even by a contact between the polyester resin and a liquid developer, and materials for forming the overcoat layer of the photosensitive layer are not dissolved in the solvent. The above effects may be due to steric hindrance of a biphenylfluorene backbone substantially perpendicular to the main chain of the polyester resin, an increase in dissociation energy between polymer chains, effective preclusion of infiltration of aliphatic hydrocarbon-based solvent, and hindered separation of materials for forming the overcoat layer of the photosensitive layer.

The present invention is described below in more detail with reference to various examples. The following examples are provided for illustration only, and the present invention is not limited thereto.

EXAMPLE 1

7 parts by weight of titanyl phthalocyanine of gamma-type, 3 parts by weight of polyvinylbutyral resin (S-LEC BH-3; made by SEKISUI CHEMICAL CO., LTD. and 290 parts by weight of ethyl acetate were placed in a sand mill for dispersion to give a charge generation layer forming composition. The charge generation layer forming composition was coated on an aluminum drum (Diameter: 30 mm; Length:260 mm) by a ring-coating method and dried, thus forming a 0.4 $\mu$m thick charge generation layer.

60 parts by weight of a polyester resin represented by Formula 5 (O—PET (m/n=7/3, MW=40000); made by KANEBO CO.), and 40 parts by weight of a charge transport material represented by Formula 7 were dissolved in 300 parts by weight of chloroform to give a charge transport layer forming composition. The charge transport layer forming composition was coated on the charge generation layer by a ring-coating method and dried, thus forming a 20 $\mu$m thick charge transport layer. Finally, a negatively (−) charged electrophotographic photoreceptor was manufactured.

EXAMPLE 2

A negatively (−) charged electrophotographic photoreceptor was manufactured in the same manner as in Example 1, except that in preparing a charge transport layer forming composition, a polyester resin represented by Formula 6 (ISARYL25S) (k=200) made by ISONOVA CO.) and a charge transport material represented by Formula 8 were used, instead of the polyester resin represented by Formula 5 and the charge transport material represented by Formula 7.

COMPARATIVE EXAMPLE 1

An electrophotographic photoreceptor was manufactured in the same manner as in Example 1, except that in preparing a charge transport layer forming composition, instead of polycarbonate Z resin (IUPILON Z-200 made by MITSUBISHI GAS KAKAKU K.K.) was used, instead of the polyester resin represented by Formula 5.

COMPARATIVE EXAMPLE 2

An electrophotographic photoreceptor was manufactured in the same manner as in Example 1, except that in preparing a charge transport layer forming composition, a general-purpose polyester resin represented by Formula 9 (VYLON-200; made by TOYOBO K.K.) was used, instead of the polyester resin represented by Formula 6.

Durability characteristics of liquid developers of the electrophotographic organic photoreceptors prepared in Examples 1–2 and Comparative Examples 1–2 to aliphatic hydrocarbon-based solvents were evaluated by a solvent soaking test, and the results are shown in Table 1.

The solvent soaking test was carried out by dipping the photoreceptor samples in a 500 mL container containing an aliphatic hydrocarbon-based solvent (ISOPAR L.; made by EXXON CHEMICAL K.K.), leaving the samples at room temperature (25° C.) for about 10 days, and a photosensitive layer of each photoreceptor sample, particularly, a charge transport layer, and the solvent.

TABLE 1

| | Solvent | Photosensitive layer |
|---|---|---|
| Example 1 | No change | No change |
| Example 2 | No change | No change |
| Comparative Example 1 | Changed into fluorescent color | Many cracks occurred in the entire surface |
| Comparative Example 2 | Changed into dark yellow | White turbidity |

The electrostatic characteristics of the electrophotographic organic photoreceptors prepared in Examples 1–2 and Comparative Examples 1–2 were evaluated using a drum photoreceptor evaluator (PDT-2000; made by QEA K.K.) as follows.

Each sample was corona-charged by a power of −7.5 kV level under the condition in which the relative speed of the charger to the photoreceptor was 100 mm/sec, and monochromatic light having a wavelength of 780 mm was irradiated with an exposure energy of 0~10 mJ/m$^2$, to measure surface potential values after exposure to evaluate a change in surface potential depending on energy. Here, ]$V_0$(V) means a surface potential without irradiation,] $V_1$(V) means a surface potential after exposure of 10 mJ/m$^2$, and ]$E_{1/2}$(mJ/m$^2$) means the energy required to reduce $V_0$ to half of an original value.

The evaluation results of electrostatic characteristics of organic photoreceptors prepared in Examples 1–2 and Comparative Examples 1–2 before and after soaking are listed in Table 2.

TABLE 2

| | ]$V_0$(V) | | ]$V_1$(V) | | ]$E_{1/2}$(mJ/m$^2$) | |
|---|---|---|---|---|---|---|
| Sample | Before soaking | After soaking | Before soaking | After soaking | Before soaking | After soaking |
| Example 1 | −709 | −723 | −22 | −26 | 1.62 | 1.61 |
| Example 2 | −685 | −718 | −25 | −29 | 1.65 | 1.63 |
| Comparative Example 1 | −671 | −732 | −15 | −103 | 1.54 | 2.23 |
| Comparative Example 2 | −725 | −786 | −57 | −254 | 2.75 | 5.92 |

As shown in Tables 1 and 2, while the photoreceptor prepared in Comparative Example 1 showed good initial electrostatic characteristics, the photoreceptor exhibited low durability against a solvent for a liquid developer, elution of charge transport materials from the photosensitive layer and cracks due to corrosion. Accordingly, the electrostatic characteristics of the photoreceptor considerably degraded after soaking.

Also, the photoreceptor prepared in Comparative Example 2 initially showed poor residual potential and sensitivity, and resulted in elution of a large amount of charge transport materials after soaking, further alleviating the electrostatic characteristics of the photoreceptor.

On the other hand, the organic photoreceptors prepared in Examples 1 and 2 had good initial electrostatic characteristics and did not erode due to soaking, that is, no degradation in electrostatic characteristics was found before and after soaking. Thus, even when the photoreceptors directly contact a liquid developer for developing, the organic photoreceptors do not erode by solvent, and the liquid developer is not contaminated, thus achieving stable development.

According to the present invention, the organic photoreceptor has effective initial electrostatic characteristics and experiences little change in electrostatic characteristics before and after soaking in a solvent for a liquid developer. Thus, even when the liquid developer directly contacts an organic photoreceptor, the organic photoreceptor does not erode by a solvent, and the developer is not contaminated, so that stable development can be performed.

While the present invention has been particularly shown and described with reference to preferred embodiments thereof, it will be understood by those of ordinary skill in the art that various changes in form and details may be made therein without departing from the spirit and scope of the present invention as defined by the following claims.

What is claimed is:

1. An electrophotographic imaging method in which a liquid developer directly contacts an electrophotographic organic photoreceptor to develop an image, wherein a binder contained in a surface layer of the organic photoreceptor comprises a polyester resin having a main chain of a biphenylfluorene repeating unit represented by Formula 1:

Formula 1

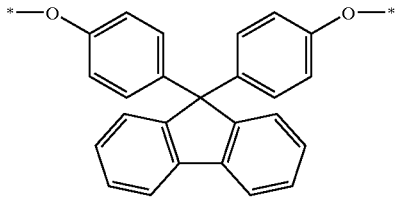

wherein hydrogen atoms on aromatic rings are unsubstituted or substituted with one selected from the group consisting of a halogen atom, an aliphatic hydrocarbon group having 1 to 20 carbon atoms and a cycloalkyl group having 5 to 8 carbon atoms, wherein the content of the polyester resin having the biphenylfluorene repeating unit represented by Formula 1 in the main chain is 50 to 100% by weight based on the total weight of the binder.

2. The method according to claim 1, wherein the polyester resin is a polyester resin having a repeating unit represented by Formula 2, 3 or 4 or a copolymer having two or more of the following categories of repeating units:

Formula 2

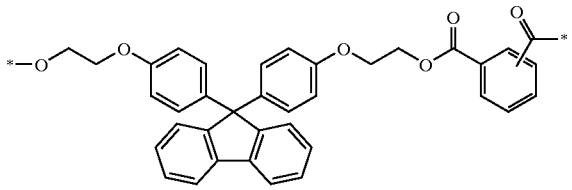

Formula 3

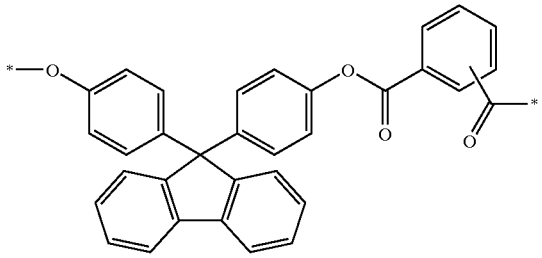

Formula 4

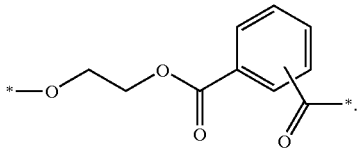

3. The method according to claim 1, herein the polyester resin is a compound represented by Formula 5 or 6:

Formula 5

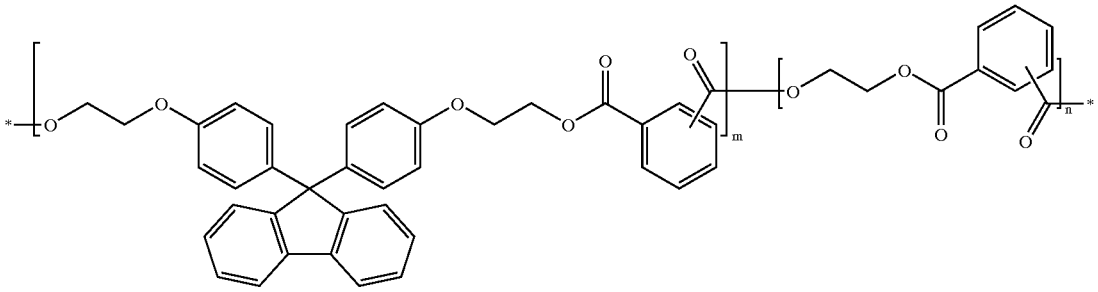

wherein m and n are independently an integer between 10 and 1000,

Formula 6

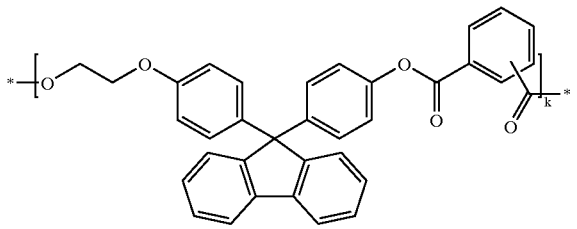

wherein k is an integer between 10 and 1000.

4. The method according to claim 1, wherein the weight average molecular weight of the polyester resin is in the range of about 20,000 to about 200,000.

5. The method according to claim 1, wherein an aliphatic hydrocarbon-based solvent is used as a solvent of the liquid developer.

6. The method according to claim 1, wherein, when the organic photoreceptor comprises a conductive base and a photosensitive layer laminated thereon, the photosensitive layer comprises a dual-layered structure in which a charge generation layer and a charge transport layer are sequentially laminated or inversely laminated.

7. The method according to claim 1, wherein, when the organic photoreceptor comprises a conductive base and a photosensitive layer laminated thereon, the photosensitive layer comprises a single layered structure in which a charge transport material, a charge generating material, and a binder are mixed.

8. The method according to claim 1, wherein the photoreceptor has a multiple layered structure in which a photosensitive layer and a overcoat layer are sequentially laminated on the conductive base.

9. The method according to claim 1, further including:

forming a photosensitive layer of the organic photoreceptor that includes a single layer structure by coating a charge generating material, a charge transport material, the binder and a solvent on a conductive base and drying, wherein the charge transport material comprises a hole transport material comprising compounds represented by Formula 7 or 8:

Formula 8

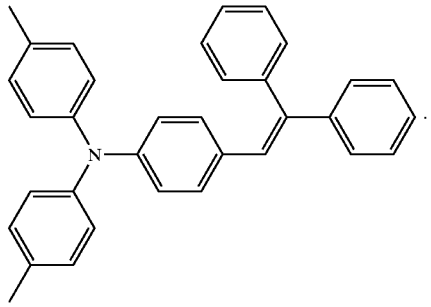

10. The method according to claim 1, wherein a photosensitive layer of the organic photoreceptor has a stacked structure, further including:

forming a charge generation layer forming composition utilizing a charge generating material, the binder, and a solvent coated on a conductive base and dried, wherein a content of the charge generating material is 20 to 90 wt % based on a weight of solid content of the charge generation layer forming composition.

11. The method according to claim 10, wherein a content of the binder is 10 to 80 wt % based on the weight of a solid content of the charge generation layer forming composition.

12. The method of claim 10, wherein a content of the charge transport material is 10 to 60 wt % based on a weight of a solid content of the charge transport layer forming composition, a content of the binder is 40 to 90 wt % based on the weight of the solid content of the charge transport layer forming composition, and the content of the polyester resin having a biphenylfluorene repeating unit represented by Formula 1 in the main chain is 50 to 100 wt % based on a total weight of the binder.

13. The method of claim 1, further including:

forming a photosensitive layer of the organic photoreceptor that includes a single layer structure by coating a charge generating material, a charge transport material, the binder and a solvent on a conductive base and drying, wherein a content of the polyester resin having the biphenyl fluorene repeating unit represented by Formula 1 in the main chain is 40 to 90 wt % based on a total amount of a solid content of a photosensitive layer forming composition, and a content of the polyester resin having a biphenylfluorene repeating unit represented by Formula 1 in the main chain is 50 to 100 wt Formula 7

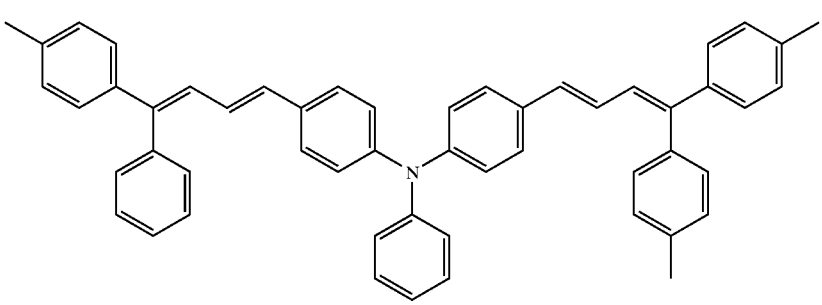

% based on a total amount of the binder used in the photosensitive layer forming composition.

14. The method of claim 1, wherein at least one hydrogen atom in the aromatic rings is substituted by one selected from the group consisting of a halogen atom, a $C_1$–$C_{20}$ aliphatic hydrocarbon and a $C_6$–$C_8$ cycloalkyl group.

15. The method of claim 14, wherein at least one hydrogen atom in the aromatic rings is substituted by one selected from the group consisting of F, Cl, Br, I, a methyl group, an ethyl group, and a cyclohexyl group.

* * * * *

UNITED STATES PATENT AND TRADEMARK OFFICE

CERTIFICATE OF CORRECTION

PATENT NO. : 6,884,559 B2
DATED : April 26, 2005
INVENTOR(S) : Saburo Yokota

It is certified that error appears in the above-identified patent and that said Letters Patent is hereby corrected as shown below:

Columns 13 and 14,
Formula 5, replace as follows:

-- Formula 5

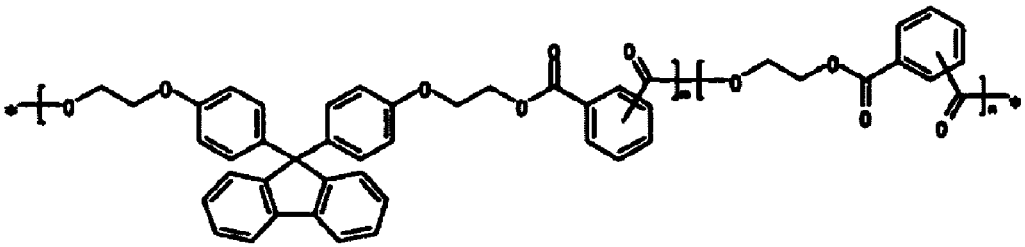

--.

Column 15,
Formula 6, replace as follows:
-- Formula 6

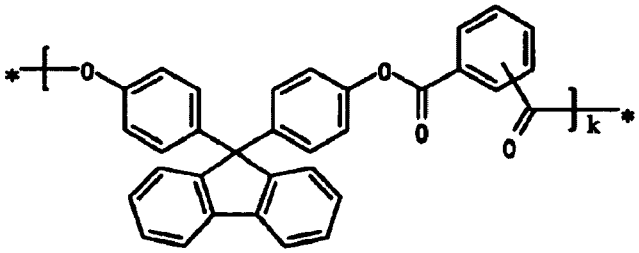

--.

Signed and Sealed this

Fourteenth Day of February, 2006

JON W. DUDAS
*Director of the United States Patent and Trademark Office*